United States Patent [19]

Koon

[11] 4,170,121

[45] Oct. 9, 1979

[54] PROTECTIVE DEVICE FOR ROLL STANDS AND THE LIKE

[75] Inventor: David L. Koon, LaPorte, Tex.

[73] Assignee: United States Steel Corporation, Pittsburgh, Pa.

[21] Appl. No.: 904,962

[22] Filed: May 11, 1978

[51] Int. Cl.[2] ..... B21D 55/00; B21B 33/00

[52] U.S. Cl. ..... 72/1; 72/30; 318/558

[58] Field of Search ..... 72/4, 1, 3, 6–12, 72/30

[56] References Cited

U.S. PATENT DOCUMENTS

| | | | |
|---|---|---|---|
| 2,985,043 | 5/1961 | Roberts | 72/13 X |
| 3,293,513 | 1/1967 | Morton | 72/10 |
| 3,651,676 | 3/1972 | Robertson | 72/12 |

*Primary Examiner*—Milton S. Mehr

*Attorney, Agent, or Firm*—Walter P. Wood

[57] ABSTRACT

A protective device for preventing a machine, such as a reversing roll stand, from receiving a new workpiece unless the machine has been reset after the previous workpiece leaves. The device includes an electronic circuit which is set automatically when the previous workpiece leaves and is reset when the machine is reset. In the example of a roll stand, the circuit permits a reverse pass and another forward pass even though the stand is not reset.

8 Claims, 2 Drawing Figures

90436

PROTECTIVE DEVICE FOR ROLL STANDS AND THE LIKE

Figure 1:
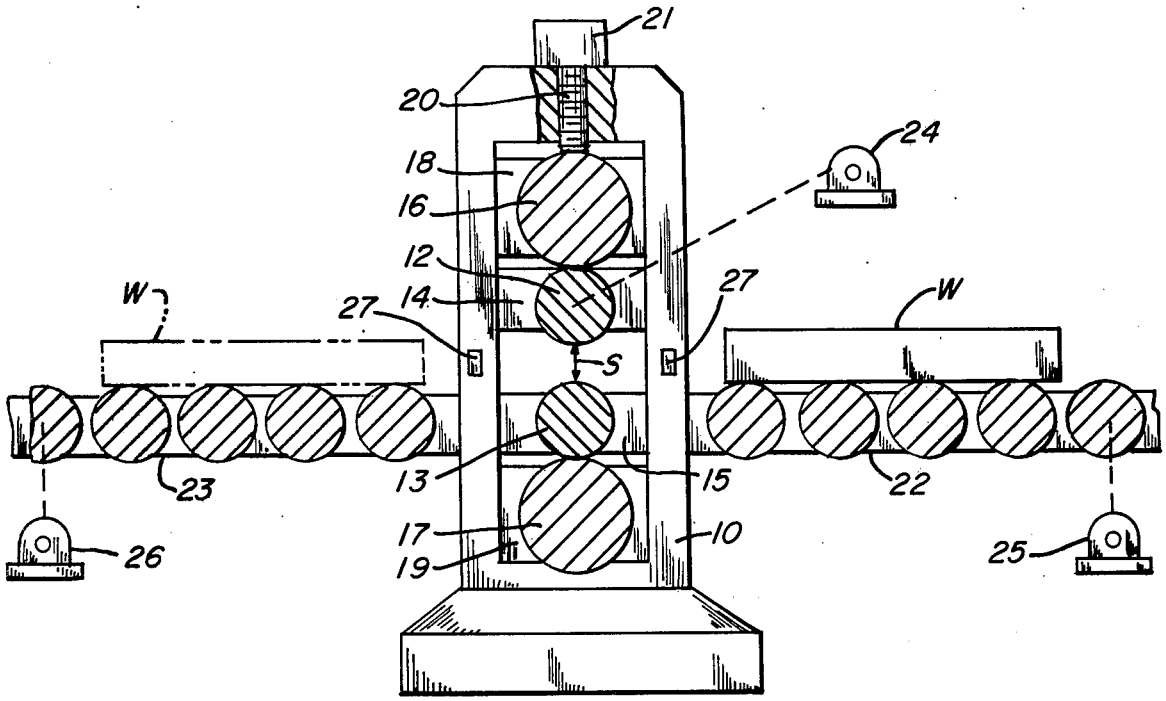

This invention relates to an improved protective device particularly for use on a reversing-type roll stand, but capable of other application.

A conventional reversing-type roll stand has a set of work rolls, which may be driven to rotate in either direction, and motor-driven screws for adjusting the spacing between the work rolls. A workpiece, for example a metal slab heated to a hot-rolling temperature, is carried to the entry side of the stand on a power-driven roller table and is rolled first in a forward pass, from which it is received on a power-driven roller table at the exit side. Next the screws of the stand are operated to decrease the roll spacing and the workpiece is rolled through a reverse pass. These steps are repeated until the workpiece is reduced to the desired thickness. Before the roll stand receives the next workpiece, the screws must be operated to open the rolls and thus reset the stand for the new workpiece.

One problem in the operation of a roll stand of this type is that the operator may negligently fail to reset the stand before a new workpiece arrives. If the spacing between the work rolls is too small when a workpiece hits them, serious damage to the stand may result.

An object of the present invention is to provide an improved protective device for preventing a machine from receiving a new workpiece unless the machine has been reset after the previous workpiece leaves.

A more specific object, as applied to a reversing-type roll stand, is to provide an improved protective device which automatically prevents the roll stand from receiving a new workpiece whenever the operator fails to reset the stand after the previous workpiece leaves.

Figure 2:
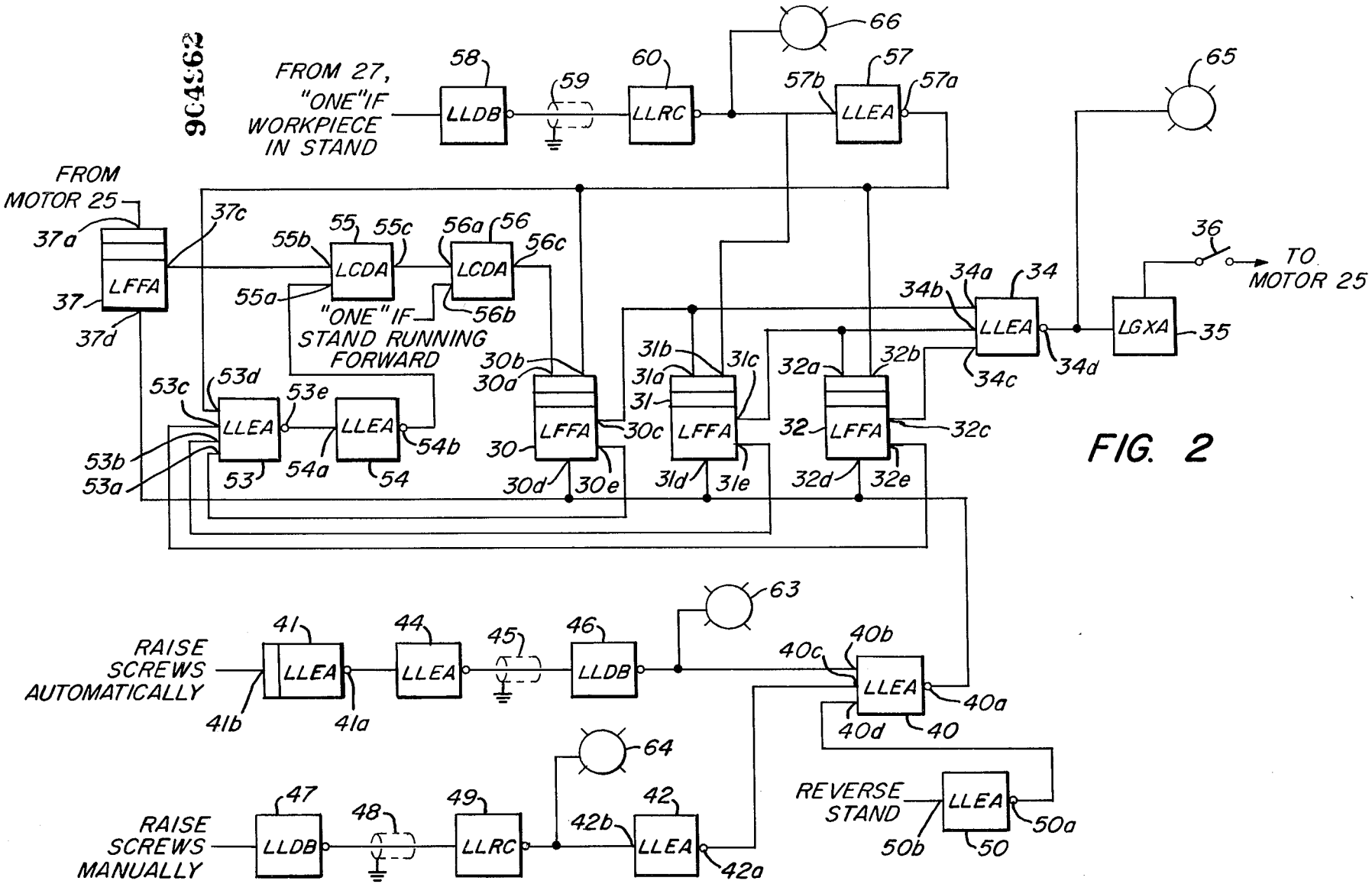

In the drawing:

FIG. 1 is a diagrammatic vertical sectional view of a conventional reversing-type roll stand to which the protective device of the invention may be applied; and FIG. 2 is a schematic diagram of an electronic circuit which is embodied in the device.

FIG. 1 shows a conventional four-high reversing-type roll stand which includes opposed housings 10, upper and lower work rolls 12 and 13 journaled in chocks 14 and 15, and upper and lower backup rolls 16 and 17 journaled in chocks 18 and 19. The stand has screws 20 at opposite sides connected to chocks 18 and driven by motors 21 through suitable reduction gearing for regulating the spacing S between the work rolls 12 and 13. Roller tables 22 and 23 are located at the entry and exit sides of the stand for carrying a workpiece W to the stand and receiving it therefrom. Reversible motors 24, 25 and 26 for driving the rolls and the two roller tables respectively are indicated schematically. The stand is equipped with suitable known means, such as strain gauges 27 mounted on the housings 10, for producing voltage signals which indicate the presence of a workpiece W between the work rolls 12 and 13. The roll stand illustrated is only one example of a rolling mill or other machine to which the protective device of the invention may be applied.

ELECTRONIC CIRCUIT

As shown in FIG. 2, the circuit includes three LFFA flip-flops 30, 31 and 32, which have respectively first "set" input pins 30*a*, 31*a* and 32*a*, second "set" input pins 30*b*, 31*b* and 32*b*, "set" output pins 30*c*, 31*c* and 32*c*, "reset" input pins 30*d*, 31*d* and 32*d*, and "reset" output pins 30*e*, 31*e* and 32*e*. Each flip-flop goes into a "set" state in which its "set" output pin is at voltage "one" (for example 6 volts) only when voltage "one" signals are applied to both its "set" input pins. Each flip-flop goes into a "reset" state in which its "reset" output pin is at voltage "one" when a voltage "one" signal is applied to its "reset" input pin. In each instance there is no voltage on the other output pin.

The circuit includes a number of gates, some of which invert the signals which they receive. In each instance FIG. 2 indicates inverting gates by showing a zero (0) at the output pin.

The three "set" output pins 30*c*, 31*c* and 32*c* are connected to three input pins 34*a*, 34*b* and 34*c* respectively of an LLEA inverting "nand" gate 34, which has an output pin 34*d* connected to a logic expander gate 35 and thence to the circuit of the drive motor 25 for the entry roller table 22. When gates 34 and 35 transmit no voltage signal to the motor circuit, the entry roller table is inhibited from running. The connection includes an on-off switch 36 which can be opened to disconnect the protective device.

The "set" output pin 30*c* of flip-flop 30 is connected also to the first "set" input pin 31*a* of flip-flop 31. The "set" output pin 31*c* of flip-flop 31 is connected also to the first "set" input pin 32*a* of flip-flop 32.

The circuit includes in addition a fourth LFFA flip-flop 37 which has a "set" input pin 37*a*, a "set" outpin pin 37*c*, and a "reset" input pin 37*d*. The "set" input pin 37*a* is connected to the drive motor 25 for the entry roller table 22. As long as the table is not running, the "set" input pin receives a voltage "one" signal. When the table is running, the set input pin receives no voltage.

The "reset" input pins 30*d*, 31*d*, 32*d* and 37*d* of all four flip-flops are connected to the output pin 40*a* of an LLEA inverting logic element gate 40, which has three input pins 40*b*, 40*c* and 40*d*. Normally all three input pins of gate 40 are at voltage "one" and the gate transmits no voltage to the flip-flops. When any one of the input pins ceases to receive a voltage, the gate transmits a voltage "one" signal to flip-flops. The input pin 40*b* is connected to the output pin 41*a* of another LLEA inverting "nand" gate 41 which has an input pin 41*b* connected to the mechanism which runs the screw motors 21 to open the work rolls 12 and 13 automatically to their proper spacing for receiving a new workpiece. The input pin 40*c* is connected to the output pin 42*a* of another LLEA inverting "nand" gate 42 which has an input pin 42*b* connected to the mechanism for actuating the screw motors 21 manually. The connection between gates 41 and 40 includes an LLDB logic driver 44, a shield 45, and an LLRC logic receiver 46, since signals must travel several feet between gates. Likewise the connection between the screw-actuating mechanism and gate 42 includes a logic driver 47, a shield 48 and a logic receiver 49. The logic driver and receiver may be located on either side of gates 41 and 42; hence I have shown the driver 44 and receiver 46 on the output side of gate 41 and the driver 47 and receiver 49 on the input side of gate 42. The input pin 40*d* is connected to the output pin 50*a* of another LLEA inverting "nand" gate 50, which has an input pin 50*b* connected to the drive of the exit roller table 23.

The "reset" output pins 30*e*, 31*e* and 32*e* of the three flip-flops 30, 31 and 32 are connected to three input pins 53*a*, 53*b* and 53*c* respectively of an LLEA inverting "nand" gate 53, which has a fourth input pin 53*d* and an output pin 53*e*. The output pin 53*e* is connected to the input pin 54*a* of another LLEA inverting "nor" gate 54 which has an output pin 54*b*. The output pin 54*b* is connected to one input pin 55*a* of an LCDA non-inverting "and" gate 55, which has another input pin 55*b* and an output pin 55*c*. The other input pin 55*b* is connected to the "set" output pin 37*c* of flip-flop 37. The output pin 55*c* is connected to one input pin 56*a* of another LCDA non-inverting "and" gate 56, which has another input pin 56*b* and an output pin 56*c*. The other input pin 56*b* is connected to means in the roll stand drive for producing a voltage "one" signal when the rolls are driven in the forward direction. The output pin 56*c* is connected to the first "set" input pin 30*a* of flip-flop 30.

The second "set" input pins 30*b* and 32*b* of flip-flops 30 and 32 and the fourth input pin 53*d* of gate 53 are connected to the output pin 57*a* of an LLEA inverting "nand" gate 57, which has an input pin 57*b*. The input pin 57*b* and the second "set" input pin 31*b* of flip-flop 31 are connected to the strain gauge 27 or other means for producing a voltage "one" signal in response to the presence of a workpiece W in the roll stand. The connection includes an LLDB logic driver 58, a shield 59, and an LLRC logic receiver 60 similar to parts already described, since signals from the roll stand must travel several feet.

Preferably the circuit includes signal lights which show visually when various operations take place. Lights 63 and 64 are connected in advance of gate 40 to indicate whether the screws have been operated. A light 65 is connected to the output of gate 34 to indicate whether the entry roller table is inhibited from running. A light 66 is connected in advance of gate 57 to indicate whether a workpiece is within the roll stand.

START UP

When the protective circuit is activated before the roll stand 10 and entry roller table 22 are running, the flip-flops 30, 31 and 32 are in their "reset" state in which their "reset" output pins 30*e*, 31*e* and 32*e* transmit voltage "one" signals (for example 6 volts) to the respective input pins 53*a*, 53*b* and 53*c* of the inverting gate 53. As long as no workpiece is in the roll stand, the inverting gate 57 transmits voltage "one" signals to the fourth input pin 53*d* of gate 53, and also to the second "set" input pins 30*b* and 32*b* of flip-flops 30 and 32. As long as all four of its input pins are at voltage "one", gate 53 inverts the signal and transmits no voltage to the inverting gate 54, which in turn transmits a voltage "one" signal to the input pin 55*a* of the non-inverting gate 55. The "set" input pin 37*a* of flip-flop 37 is at voltage "one", and the set output pin 37*c* transmits a voltage "one" signal to the other input pin 55*b* of gate 55, which in turn transmits a voltage "one" signal to the input pin 56*a* of the non-inverting gate 56.

When the roll stand 10 starts to run in a forward direction, it transmits a voltage "one" signal to the input pin 56*b* of gate 56. The gate transmits a voltage "one" signal to the first "set" input pin 30*a* of flip-flop 30, whereupon the flip-flop goes into its "set" state. The "set" output pin 30*c* transmits voltage "one" signals to the first "set" input pin 31*a* of flip-flop 31 and to the first input pin 34*a* of the inverting gate 34.

When the roller table 22 carries the first workpiece into the roll stand 10, the roll stand transmits a voltage "one" signal to the second "set" input pin 31*b* of flip-flop 31, whereupon the latter flip-flop goes into its "set" state. The "set" output pin 31*c* transmits voltage "one" signals to the first "set" input pin 32*a* of flip-flop 32 and to the second input pin 34*b* of the inverting gate 34. It may be noted that when table 22 starts to run and when the workpiece enters the roll stand 10, the voltage "one" signals are removed from the "set" input pins 37*a* and 30*b*, but this does not change the output signals from the respective flip-flops.

When the first workpiece leaves the roll stand, the inverting gate 57 transmits a voltage "one" signal to the second "set" input pin 32*b* of flip-flop 32, whereupon the latter flip-flop goes into its "set" state. The "set" output pin 32*c* transmits a voltage "one" signal to the third input pin 34*c* of the inverting gate 34. Thus all three input pins of gate 34 are at voltage "one". There is no voltage on the output pin 34*d*, and the roller table 22 is inhibited from running and carrying another workpiece into the roll stand.

RESETTING THE FLIP-FLOPS

The flip-flops 30, 31, 32 and 37 can be reset to permit the roll stand 10 and roller table 22 to operate in response to any one of three actions: (1) When the operator actuates the mechanism which runs the screw motors 21 to open the rolls automatically to their proper spacing for a new workpiece, (2) When the operator actuates the screw motors maually to increase the roll spacing, or (3) When the exit roller table 23 operated in the reverse direction to return the workpiece to the roll stand for a reverse pass. If the pass just completed is not the last to which the workpiece is to be subjected, reverse operation of the exit roller table provides the resetting signal in order that the protective device does not interfere with the next reverse and forward passes. If the pass is the last, the workpiece moves on to the next roll stand and the screw motors must be operated to provide the resetting signal. If the operator fails to operate the screws, he will not receive a new workpiece.

PASS NOT THE LAST

Since the forward pass just described is assumed to be the first to which the workpiece is subjected, a reverse pass usually follows, and the flip-flops are reset by reverse operation of the exit roller table 23. When the exit roller table starts to run, it transmits a voltage "one" signal to the input pin 50*b* of the inverting gate 50, which ceases to transmit a voltage to the input pin 40*d* of the inverting gate 40. Gate 40 transmits voltage "one" signals to the "reset" input pins 30*d*, 31*d*, 32*d* and 37*d* of the respective flip-flops, whereupon the flip-flops go back to their reset state. The set output pins 30*c*, 31*c*, and 32*c* cease to transmit voltage to the inverting gate 34, and the roll stand 10 and roller table 22 no longer are inhibited from running.

When each flip-flop 30, 31 and 32 in turn went into its "set" state, its "reset" ouput pin 30*e*, 31*e* and 32*e* ceased to transmit voltage to the inverting gate 53. This removed the voltage "one" signal from the first "set" input pin 30*a* of flip-flop 30, but did not affect the output from the flip-flop. When the flip-flops return to their reset state, voltage "one" signals are transmitted to gate 53 as before. When the roller tables stop, the circuit is back to its original condition.

LAST PASS

When the operator actuates the screw motors 21 either automatically or manually, gate 41 or 42 ceases to transmit a voltage to the inverting gate 40, which in either instance commences to transmit a voltage one signal to the "reset" input pins. The subsequent action is the same as when the reset signal originates from the exit roller table 23 already described. The circuit operates in like manner for each succeeding workpiece.

The various electronic components per se are conventional, and suitable components are available as off-the-shelf items from several manufacturers. Hence I have not shown these components in detail.

From the foregoing description it is seen that my invention affords a relatively simple electronic device which protects a roll stand or other machine against operator error in failing to reset the machine before a new workpiece arrives. The electronic components are simple and compact yet assure that the machine does not receive a new workpiece unless reset.

I claim:

1. The combination, with a machine which receives a workpiece, performs an operation thereon, and requires resetting before receiving a new workpiece, of a protective device which prevents reception of the new workpiece unless the machine has been reset, said device comprising electronic means which is set as a workpiece leaves the machine and thereby prevents reception of another workpiece, and means connected with said electronic means for resetting the electronic means to permit reception of a new workpiece in the machine when the machine is reset.

2. A combination as defined in claim 1 in which said machine is a reversing roll stand having a pair of work rolls and means for adjusting the spacing between said rolls, and in which the resetting step includes increasing the spacing between said rolls.

3. A combination as defined in claim 2 in which said electronic means includes means permitting said roll stand to receive a workpiece for a reverse pass even though the roll stand has not been reset.

4. A combination as defined in claim 2 in which said electronic means includes flip-flops, means connected to said flip-flops for setting them when a workpiece leaves the roll stand, means connected to said flip-flops for resetting them when said roll stand is reset or whe a workpiece is returned to the roll stand for a rever pass, and means connected to said flip-flops for inhibit ing the entry of a workpiece to the roll stand when said flip-flops are in a set state.

5. A combination as defined in claim 1 in which said machine is a reversing roll stand having a pair of work rolls and means for adjusting the spacing between said rolls, and in which the resetting step includes increasing the spacing between said rolls, said combination further comprising entry and exit roller tables for carrying a workpiece to said roll stand and receiving it therefrom, and in which the means for preventing reception of a workpiece in the roll stand includes means inhibiting operation of said entry roller table.

6. A combination as defined in claim 5 in which said electronic means includes means permitting said entry roller table to operate for a reverse pass and another forward pass of a workpiece through said roll stand even though the roll stand has not been reset.

7. A combination as defined in claim 5 in which said electronic means includes flip-flops, means connected to said roll stand to said flip-flops for setting them when a workpiece passes from said roll stand to said exit roller table, means connected to said flip-flops for resetting them when said roll stand is reset or when said exit roller table operates in reverse to return a workpiece to said roll stand for a reverse pass, and means connected to said flip-flops for inhibiting operation of said entry roller table when said flip-flops are in a set state.

8. A combination as defined in claim 7 in which the means for resetting the flip-flops includes a gate normally transmitting no voltage to the flip-flops, and means for operating the gate to transmit a resetting voltage when the roll stand is reset or when the exit roller table operates in reverse.

* * * * *